United States Patent [19]

Stankowitz

[11] 4,364,521

[45] Dec. 21, 1982

[54] TEXTURE APPLICATOR

[76] Inventor: James L. Stankowitz, 6946 Exline Rd., Jacksonville, Fla. 32222

[21] Appl. No.: 174,591

[22] Filed: Aug. 1, 1980

[51] Int. Cl.[3] ..... B05B 9/02

[52] U.S. Cl. ..... 239/346; 239/391; 239/397

[58] Field of Search ..... 239/337, 340, 346, 390, 239/391, 397

[56] References Cited

U.S. PATENT DOCUMENTS 2,904,262 9/1959 Peeps ..... 239/346 X 3,945,571 3/1976 Rash ..... 239/337 X

FOREIGN PATENT DOCUMENTS 304495 1/1929 United Kingdom ..... 239/346

*Primary Examiner*—Richard A. Schacher

*Attorney, Agent, or Firm*—Harvey B. Jacobson

[57] ABSTRACT

A portable, self-contained unit for the application of textured wall and ceiling covering material comprises a pressure tank adapted to be charged from an external source or by a manually actuatable pump incorporated in the tank. A pressure line containing a regulator connects the tank to an applicator gun having a longitudinally displaceable nozzle which directs the pressurized air across the bottom of a hopper containing textured material. Various tips for the gun are available to control the amount and texture of the material applied.

10 Claims, 6 Drawing Figures

TEXTURE APPLICATOR

BACKGROUND OF THE INVENTION

1. Field of the Invention

This invention relates to pressure operated spray applicators and specifically to such applicators designed to apply textured materials to perform touchup and repair work on walls and ceilings of rooms.

2. Discussion of Related Art

Often, in the construction of new buildings utilizing a blown texture finish for the walls and ceilings, it is desirable to have a means of applying touchup textured wall covering which matches that previously applied for certain touchups such as the repair of blisters or finishing around light boxes. Furthermore, in the repair of older homes or during remodeling certain problems occur such as covering of cracks in the walls or ceilings, the repair of which requires the application of a wall texture material which matches that previously applied. Accordingly, it would be desirable to have an applicator which is easily maneuverable and capable of applying a small amount of texture material in a manner whereby the actual texture of the applied finish can be adjusted to the previously existing surface.

U.S. Pat. No. 3,945,571, issued Mar. 23, 1976 to Rash, shows a self-contained portable pressure apparatus and hand gun assembly for applying a texture coating material to walls for textured touchup and the like. The Rash apparatus includes a pressurized tank releasably fastened on a backpack carrier for carrying the tank on the back of a user during operation thereof. A line pressure control and a flexible hose coupling assembly couples the tank to a spray gun having a feed hopper. U.S. Pat. No. 2,529,645, issued Nov. 14, 1950 to Winks et al shows a spraying apparatus having an air pressure tank which is manipulated by hand to build up a pressure in the container by which liquid is discharged through a spray nozzle. U.S. Pat. No. 3,802,511, issued Apr. 9, 1974 to Good, Jr., shows a portable fire extinguisher having a backpack water tank connected by a hose to a hand held gun having a discharge nozzle and a selectably operable compressed gas driven pump positioned between the tank and the nozzle for pumping water at high pressure through the nozzle. U.S. Pat. No. 3,966,092, issued June 29, 1976 to Ballu, shows a manually operated man portable sprayer comprising a reciprocating pump, the body of which extends through the upper wall of a reservoir through which it can be caused to slide by a side mounted actuating lever. The pump is disposed centrally in relation to the reservoir. Force is transmitted to the actuating lever to the pump body by a stirrup-shaped 2-branch connecting rod having its top hingedly connected to the pump body and coextensive therewith.

SUMMARY OF THE INVENTION

One object of the present invention is to provide a texture applicator which is adapted to dispense various types of texture for walls and popcorn for ceilings with the ability to vary the coarseness of the applied surface.

Another object of the present invention is to provide a texture applicator which is designed to repair spots as small as one inch in diameter or as large as 30 to 50 square feet.

Yet a still further object of the present invention is to provide a texture applicator which is completely portable in order to enable it to be carried quickly and easily from one location to another to perform touchup and repair jobs.

Yet another additional object of the present invention is to provide a texture applicator having a pressure tank which can be pressurized from an external source or can be manually pressurized by use of a pump incorporated in the tank.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
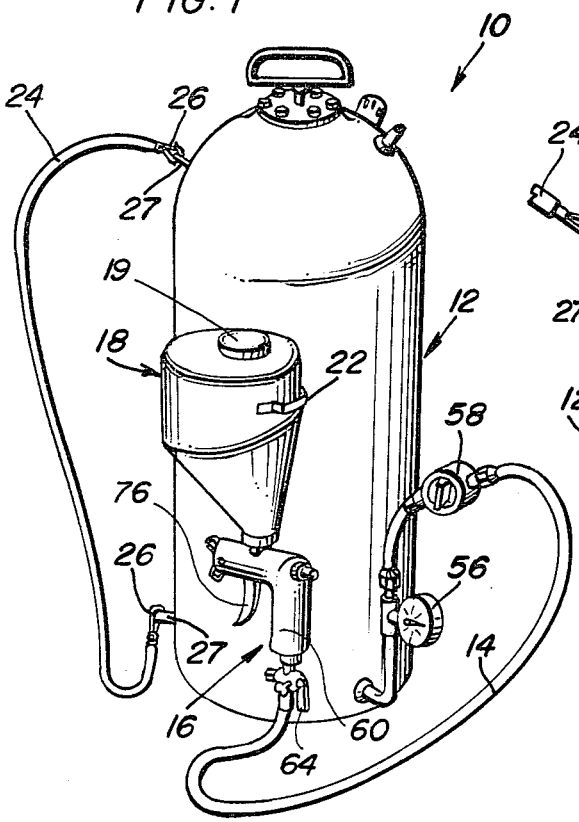
FIG. 1 is a perspective view of the texture applicator of the present invention.

Now with reference to the drawings, a texture applicator incorporating the principles and concepts of the present invention and generally referred to by the reference numeral 10 will be described in detail. With particular reference to FIG. 1, it will be seen that the applicator includes a pressure tank 12 for storing pressurized air and dispensing the pressurized air through tube 14 to applicator gun 16. The applicator gun includes a covered hopper 18 which contains the material to be sprayed. The texture material is loaded into the hopper 18 through an opening in the top after removal of screw on cap 19. A hook (not shown) is conveniently positioned on the side of the tank 12 and receives loop 22 extending from the hopper 18 so that the gun with hopper can be removably placed on the hook when the device is to be transported or stored. A carrying strap 24 removably attaches to the rear of the tank 12 by use of clasps 26 which engage eye members 27. Accordingly, it can be seen that the entire unit can be easily picked up and carried by a single person by draping the carrying strap over one's shoulder. The gun 16 with hopper 18 extends to the side of the pressure tank so as to not interfere with the person carrying the assembly.

Figure 2:
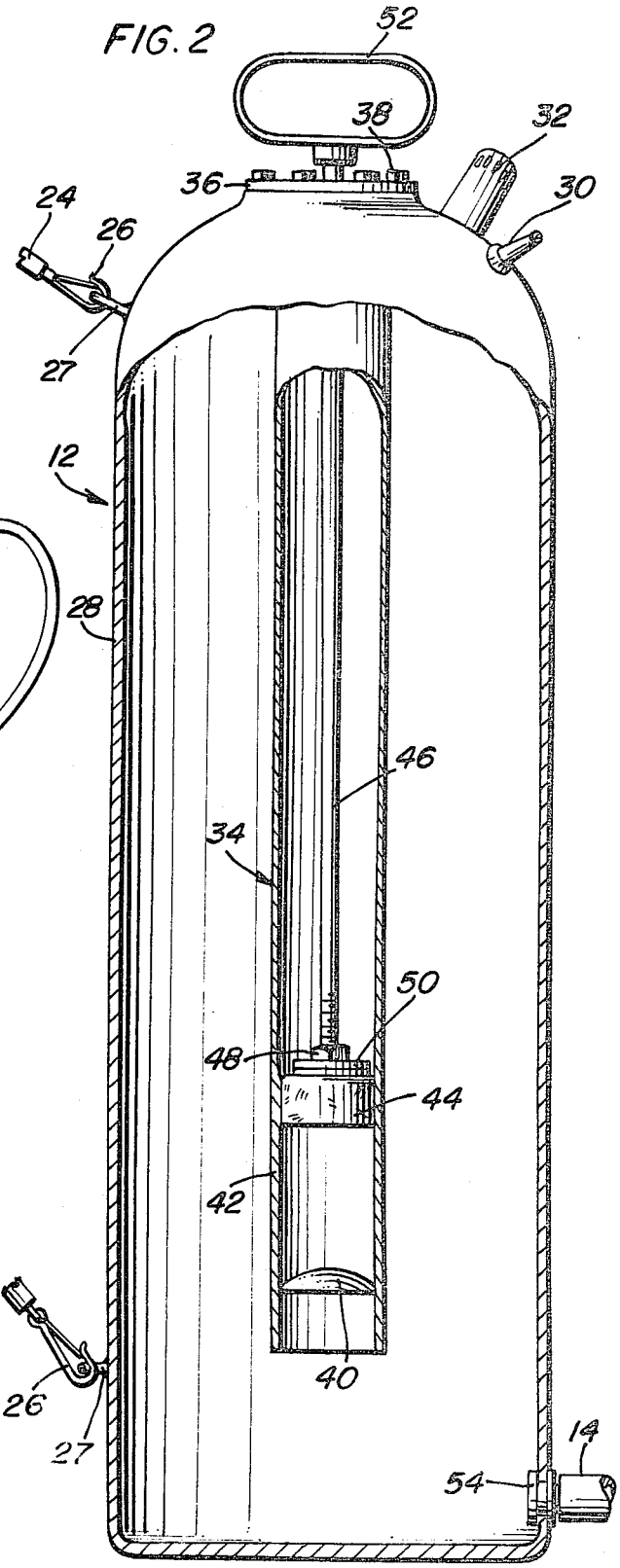
FIG. 2 is an elevational view of the pressure tank with portions broken away showing the manually actuatable pump disposed therein.
Figure 6:
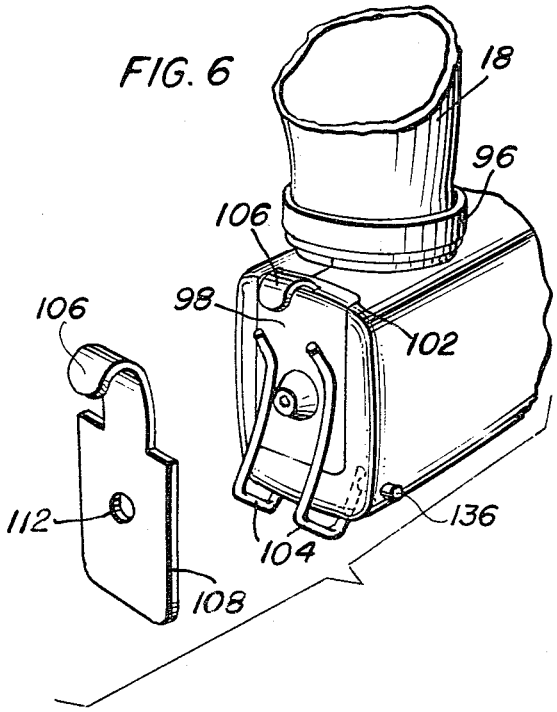
FIG. 6 is a detailed view showing the interchangeable tips for use with the applicator gun.
Figures 3, 4, 5:
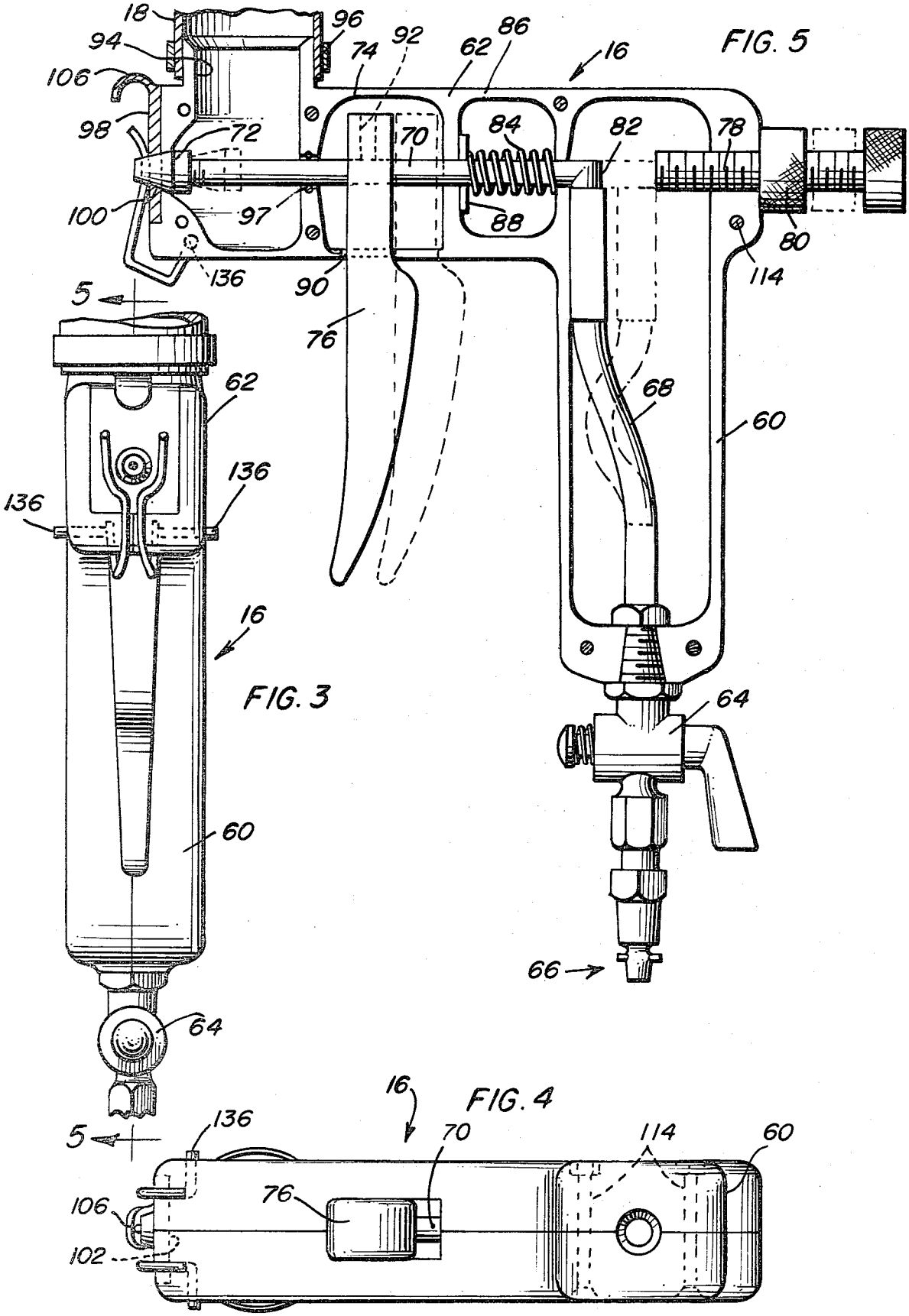
FIG. 3 is a front elevational view of the applicator gun.
FIG. 4 is a bottom plan view of the applicator gun.
FIG. 5 is a longitudinal sectional view of the applicator gun taken substantially along a plane passing through section line 5—5 of FIG. 3.

With reference to FIG. 2, it can be seen that the pressure tank 12 comprises a casing 28 formed from any suitable material such as metal or the like capable of withstanding of pressures of approximately 150 psi. An air inlet 30 extends through the top of the casing and contains a one way valve for allowing the tank to be filled from a conventional external source of pressurized air. A pressure relief valve 32 is also provided in the casing to prevent over pressurization thereof. In the event that an external pressure source is not available, a manually actuatable pump 34 is disposed within the casing. The top of the pump is attached to a plate 36 which is bolted to the casing by use of bolts 38 so that plate 36 and pump 34 can be removed for repair of the pump or for cleaning the interior of the tank. The pump 34 is a conventional air pump having a rubber gasket 40 in the lower portion of housing 42. Gasket 40 acts as a one way valve to allow air to exit from the pump when leather plunger 44 is moved downwardly. On the up stroke, plunger 44 collapses inwardly to let air pass thereby for filling the pump from an air hole inlet (not shown) contained in plate 36. The plunger 44 is mounted to shaft 46 by use of nuts 48 and washers 50. Shaft 46 extends upwardly through plate 36 and is attached to handle 52 which can be grasped by the user to operate the pump thus filling the air tank. An air outlet 54 is contained in the lower portion of the tank and connects the tank to tube 14. As shown in FIG. 1, the tube contains an air pressure gauge 56 for indicating the air pressure in the tank and a regulator 58 by which the air pressure applied through hose to the gun 16 can be controlled.

With reference to FIGS. 3-6, it will be seen that the gun 16 includes a housing having a handle 60 and a barrel 62. The handle is threadedly connected to shut off valve 64 which attaches to the tube 14 by a quick disconnect fitting shown generally at 66. Air entering the gun flows through the valve 64 and into flexible tube 68 which connects directly to the discharge tube 70. Discharge tube 70 has a depending portion which connects to the flexible tube 68 and a longer portion which extends through the center of the barrel 62 and threadedly attaches to nozzle 72. The discharge tube itself should be formed from any suitably stiff material such as copper, aluminum or the like. The barrel 62 contains several chambers one of which, shown at 74, is used to mount trigger 76 to the discharge tube in order to move the tube longitudinally of the barrel. The rearward movement of the tube is halted by a stop mechanism comprising bolt 78 which is threaded through the rear of the barrel and affixed in place by stop nut 80. The foremost surface of the bolt 78 contacts an abutment surface 82 formed by the depending portion of discharge tube 70. Accordingly, by adjustment of the bolt 78, it can easily be seen that the rearward movement of the discharge tube is appropriately limited. The discharge tube is biased forwardly within the barrel by a spring 84 contained in a spring chamber 86. The spring is a compression spring which abuts against the rear wall of chamber 86. The forward end of the spring pushes against a disc 88 which is affixedly attached to the discharge tube 70 thus forcing the tube forwardly. Naturally, movement of the tube is controlled by trigger 76 which extends downwardly from chamber 74 through slot 90 whereat it can be conveniently grasped by the user's hand with the handle 60 being held firmly. The position of the trigger 76 on discharge tube 70 can be adjusted by loosening a set screw (not shown) disposed in hole 92 through which the set screw extends in abutting relation with the tube. With the set screw loosened, the trigger 76 can be slid along the tube to the desired position and the set screw retightened.

The forwardmost chamber in the barrel is shown at 94 and comprises the fluid supply chamber. Chamber 94 has an open top which communicates with the interior of hopper 18. The hopper is held in place on the chamber by a strap 96 which extends about the lower portion of the hopper and presses it firmly against the outer wall forming the upper portion of chamber 94. The fluid texture material in the hopper flows downwardly into chamber 94 and is inhibited from flowing through the rest of the barrel 62 by a seal comprising O-ring 97 which is disposed in an annular groove formed in the wall between chambers 94 and 74 surrounding the discharge tube 70.

The nozzle 72 has a frusto-conical outer surface which fits within a complementary opening 100 in a tip 98 when the trigger 76 is released. In this manner, with valve 64 in the off position, no pressurized air or mixture is emitted from the gun. The tip can be locked in the off position by simply inserting bolt 78 fully into the rear of the gun barrel to fix the tip in the off position. When the bolt 78 is backed off from the abutment surface 82, the trigger 76 is free to move the discharge tube and nozzle 72. Pressurized air is emitted from the nozzle 72 when valve 64 is opened. This pressure will draw texture material from chamber 94 forcing the material through the opening 100 of the tip. The degree to which the texture material is emitted from the gun is, of course, determined by the rearward displacement of trigger 76. Also, the size of the opening 100 in the tip determines the speed of flow from the gun and the final appearance of the texture material when it is applied to a wall or ceiling. Thus, gun 16 is adapted to allow for interchangeability of tips 98. Tip 98 is held in a recess 102 formed in the front of the barrel by a pair of spring clips 104. The spring clips are held in place in the barrel by set screws 136. When it is desired to remove the tip 98 from the gun, trigger 76 is pulled rearwardly and the tip 98 is grasped by forwardly extending finger grip 106. The tip 98 can then be slid upwardly and out of recess 102 to be replaced by an alternate tip such as shown at 108 in FIG. 6. Naturally, tip 108 has a central opening 112 which differs in size from opening 100 of tip 98. As many tips as desired can be provided for placement in recess 102.

For ease of construction, the entire gun is formed in two symmetrical halves. Each of the halves can be machined or molded to the desired dimensions and connected together by suitable alignment pins, screws 114 or the like. When properly constructed, the entire texture applicator 10 can be stored and left unattended for long periods with pressure stored in the tank ready to be used. It can be carried to the site of use in one hand as an entire assembly while the operator carries material, etc. in the other hand. The hopper 18 is simply filled from a bulk tank when the apparatus is ready for use.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An apparatus for the application of a fluent material to a surface, said apparatus comprising, in combination:

an air pressure tank, inlet means on said pressure tank for filling said pressure tank from an external source of pressurized air, an outlet on said pressure tank for allowing pressurized air to be released therefrom;

a removable manually actuatable pump means disposed within said pressure tank for manually filling said pressure tank;

a supply tube attached to said outlet, said supply tube including a pressure regulator attached thereto for regulating the output pressure from the said pressure tank; and an applicator gun having an inlet containing an on-off valve attached to said supply tube, a discharge tube extending longitudinally of said gun and having at an end a depending portion including an abutment surface, the depending portion connected by a flexible tube to said inlet, said discharge tube having at another end a free distal end with a nozzle connected thereto, means for displacing said supply tube longitudinally of said gun, a removable tip received in a recess disposed in said gun and being maintained therein by spring clip means attached to said gun and for pressing against said tip, said tip having a discharge orifice removably and engagably attached to said gun, said nozzle having a frusto-conical outer surface and said orifice of the removable tip having a complementary frusto-conical inner surface for receiving said frusto-conical outer surface of said nozzle, fluent material discharge chamber surrounding a portion of said free end of said discharge tube and having an open top communicating with a covered hopper, and a threadedly disposed stop means threadedly engaging and extending through a near wall of the gun for stopping rearward displacement of said discharge tube by contact against said abutment surface at a predetermined location thereof and at its closed location providing an interlock against said abutment surface.

2. The invention as defined in claim 1 wherein said removably manually actuatable pump means extends through the top of said pressure tank and is attached thereto by a plate removably bolted to said pressure tank allowing for repair and cleaning of the pump and the interior of the tank.

3. The invention as defined in claim 1 wherein said tip further includes a forwardly extending finger grip for sliding said removable tip from said recess for replacement by a tip having a different sized central opening.

4. The invention as defined in claim 1 wherein said means for displacing includes a trigger attached to said discharge tube extending outwardly from said gun through a slot formed in said gun.

5. The invention as defined in claim 4 and further including a pressure gauge connected to said supply tube between said pressure tank and said pressure regulator.

6. The invention as defined in claim 1 and further including a carrying strap removably affixed to said pressure tank, said pressure tank further including a clip means for removably attaching said gun to said pressure tank.

7. The invention as defined in claim 1 and further wherein said gun includes a spring chamber containing a compression spring operatively connected between one wall of said spring chamber and said discharge tube for forcing said discharge tube forwardly of said gun.

8. The invention as defined in claim 7 wherein said stop means includes a bolt threadedly connected through the rear of said gun and a stop nut threadedly attached to said bolt.

9. The invention as defined in claim 1 wherein the gun includes a forwardly extending finger grip for sliding the tip from said gun and trigger means associated with the displacing means and attached to the discharge tube extending outwardly from the gun through a slot formed in the gun.

10. The invention of claim 1 wherein an interlock is provided to abut against an abutment surface on the discharge tube, the gun including a spring chamber containing a compression spring operatively connected between one wall of said spring chamber and a selected point on said discharge tube for forcing and biasing said discharge tube forwardly of said gun.

* * * * *